US012460340B2

(12) United States Patent
Wright et al.

(10) Patent No.: US 12,460,340 B2
(45) Date of Patent: Nov. 4, 2025

(54) LAUNDRY MACHINE INCLUDING AGITATOR AND LID FOR SOFTENER FLUID

(71) Applicant: Haier US Appliance Solutions, Inc., Wilmington, DE (US)

(72) Inventors: Troy Marshall Wright, Louisville, KY (US); Senthil Kandasamy, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 110 days.

(21) Appl. No.: 18/353,640

(22) Filed: Jul. 17, 2023

(65) Prior Publication Data

US 2025/0027253 A1 Jan. 23, 2025

(51) Int. Cl.
*D06F 39/02* (2006.01)
*D06F 23/04* (2006.01)

(52) U.S. Cl.
CPC ..... *D06F 39/024* (2013.01); *D06F 23/04* (2013.01)

(58) Field of Classification Search
None
See application file for complete search history.

(56) References Cited

U.S. PATENT DOCUMENTS

| | | | | |
|---|---|---|---|---|
| 3,370,444 | A | 2/1968 | Wolters | |
| 4,186,574 | A | 2/1980 | Sundstrom | |
| 10,151,058 | B2 | 12/2018 | Carpenter et al. | |
| 2009/0293203 | A1* | 12/2009 | Hettinger | D06F 39/024 68/17 A |
| 2010/0095715 | A1* | 4/2010 | Ulger | D06F 35/001 68/17 R |
| 2022/0251759 | A1 | 8/2022 | Lee et al. | |

FOREIGN PATENT DOCUMENTS

| | | | | |
|---|---|---|---|---|
| CA | 2169814 | A1 * | 9/1996 | D06F 39/024 |
| EP | 3383442 | A2 | 10/2018 | |
| KR | 100577190 | B1 | 5/2006 | |
| WO | WO-2006016800 | A1 * | 2/2006 | C09D 1/00 |
| WO | WO2007101062 | A1 | 9/2007 | |

* cited by examiner

*Primary Examiner* — Cristi J Tate-Sims
(74) *Attorney, Agent, or Firm* — Dority & Manning, P.A.

(57) ABSTRACT

A laundry machine appliance is provided, including a cup including an upper lip and attachable to a base positioned at a shaft of an agitator at a wash basket. A cap is positioned atop the shaft of the agitator, the cap including an outer cylindrical wall and a trough wall extending radially inward from the outer cylindrical wall and sloped vertically downward toward the cup. The trough wall includes a radially inward end positioned vertically upward of the upper lip of the cup. A clearance gap is formed between the upper lip and the inward end of the trough wall. A lid is selectively attachable to the cap at the trough wall. The lid includes a cylindrical wall extending vertically when attached to the cap and a sloped wall corresponding to the trough wall.

18 Claims, 5 Drawing Sheets

LAUNDRY MACHINE INCLUDING AGITATOR AND LID FOR SOFTENER FLUID

FIELD OF THE INVENTION

The present subject matter relates generally to laundry machine apparatuses.

BACKGROUND OF THE INVENTION

Conventional laundry machines may include a receptacle for receiving a fluid, such as a fabric softener solution. Users may pour the fluid into the receptacle and the laundry machine is configured to dispense the fluid at a desired portion of the wash cycle.

However, a user may occasionally or accidentally overfill the receptacle. When the receptacle is overfilled, fluid may escape over the top (e.g., during a spin cycle), which can lead to rust, degradation, or deterioration of the basket.

Accordingly, a laundry machine including features addressing the aforementioned issues would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a top-load laundry machine appliance, the top-load laundry machine appliance including a tub and a wash basket rotatably provided within the tub. An agitator is disposed in the wash basket to impart an oscillatory motion in the wash basket. The agitator includes a vertically extending shaft and an oscillatory member extending from the shaft. A cup includes an upper lip and attachable to a base positioned at the shaft of the agitator. A cap is positioned atop the shaft of the agitator, the cap including an outer cylindrical wall and a trough wall extending radially inward from the outer cylindrical wall and sloped vertically downward toward the cup. The trough wall includes a radially inward end positioned vertically upward of the upper lip of the cup. A clearance gap is formed between the upper lip and the inward end of the trough wall. A lid is selectively attachable to the cap at the trough wall. The lid includes a cylindrical wall extending vertically when attached to the cap and a sloped wall corresponding to the trough wall.

Another aspect of the present disclosure is directed to a laundry machine appliance, the laundry machine appliance including a tub and a wash basket rotatably provided within the tub. An agitator is disposed in the wash basket to impart an oscillatory motion in the wash basket. The agitator includes a vertically extending shaft and an oscillatory member extending from the shaft. A cup includes an upper lip and coupled to a base positioned at the shaft of the agitator. A cap is positioned atop the shaft of the agitator, the cap including an outer cylindrical wall and a trough wall extending radially inward from the outer cylindrical wall and sloped vertically downward toward the cup. The trough wall includes a radially inward end positioned vertically upward of the upper lip of the cup. A clearance gap is formed between the upper lip and the inward end of the trough wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
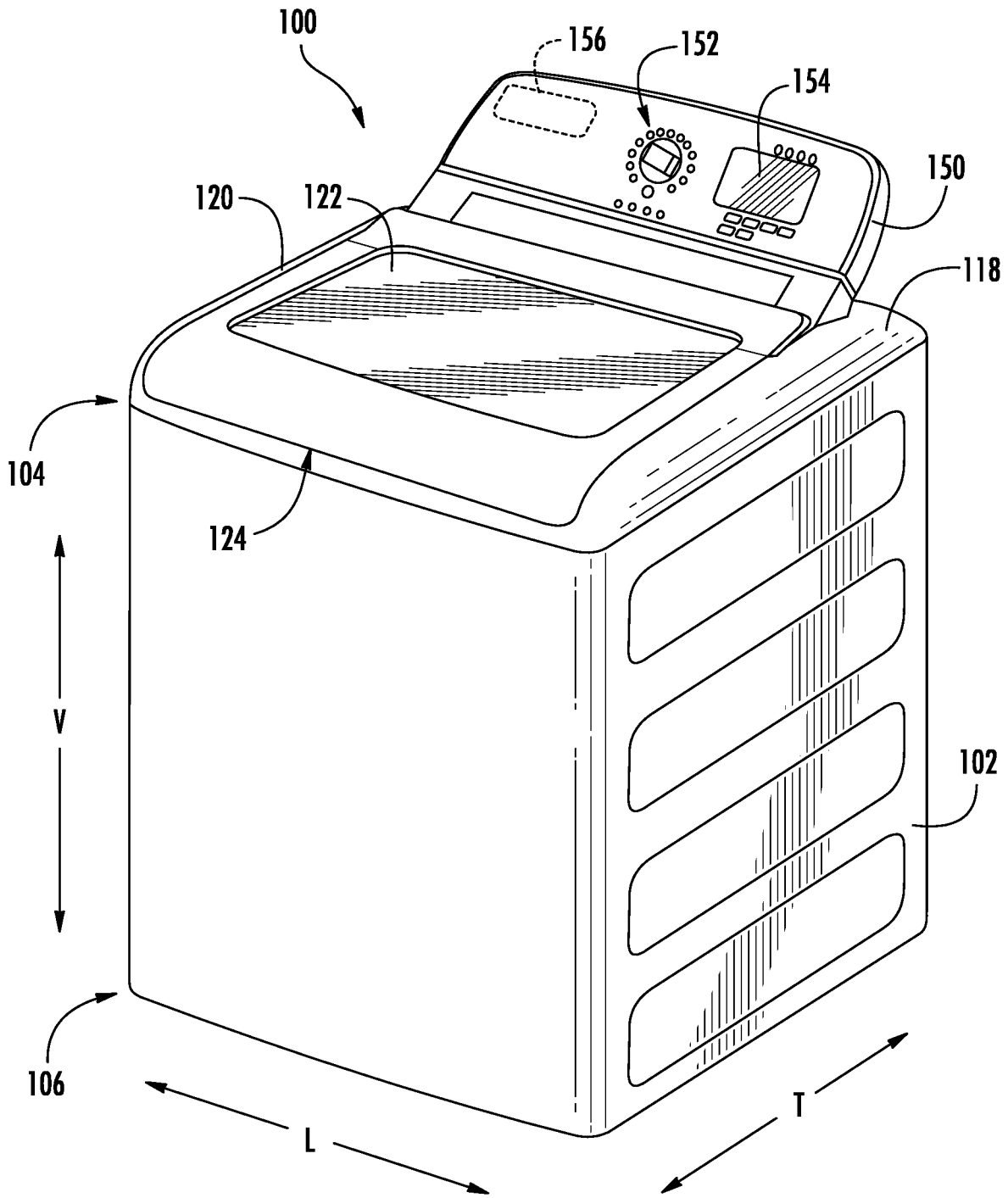
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
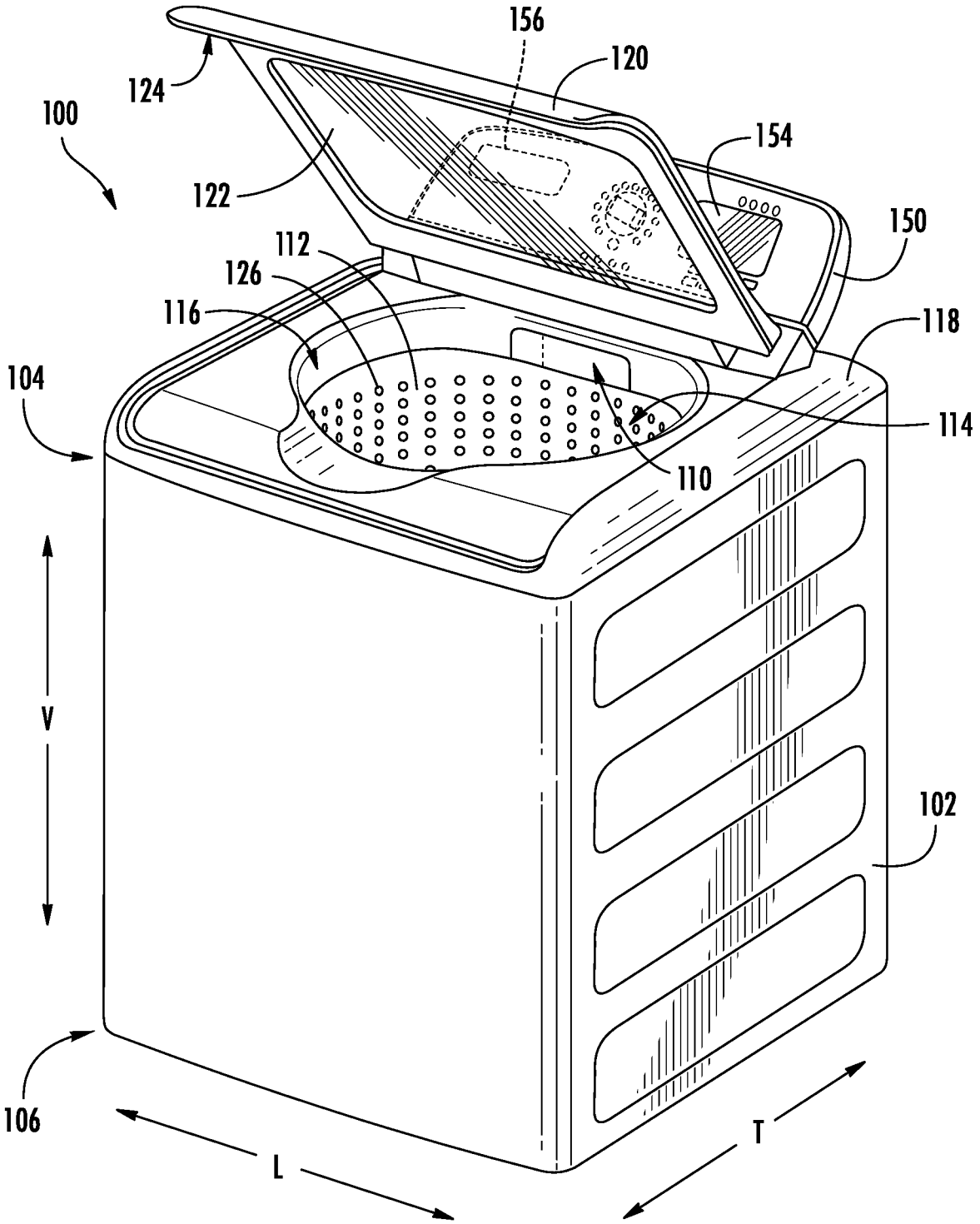
FIG. 2 provides a perspective view of the exemplary laundry machine appliance of FIG. 1 with the lid in an open position.
Figure 3:
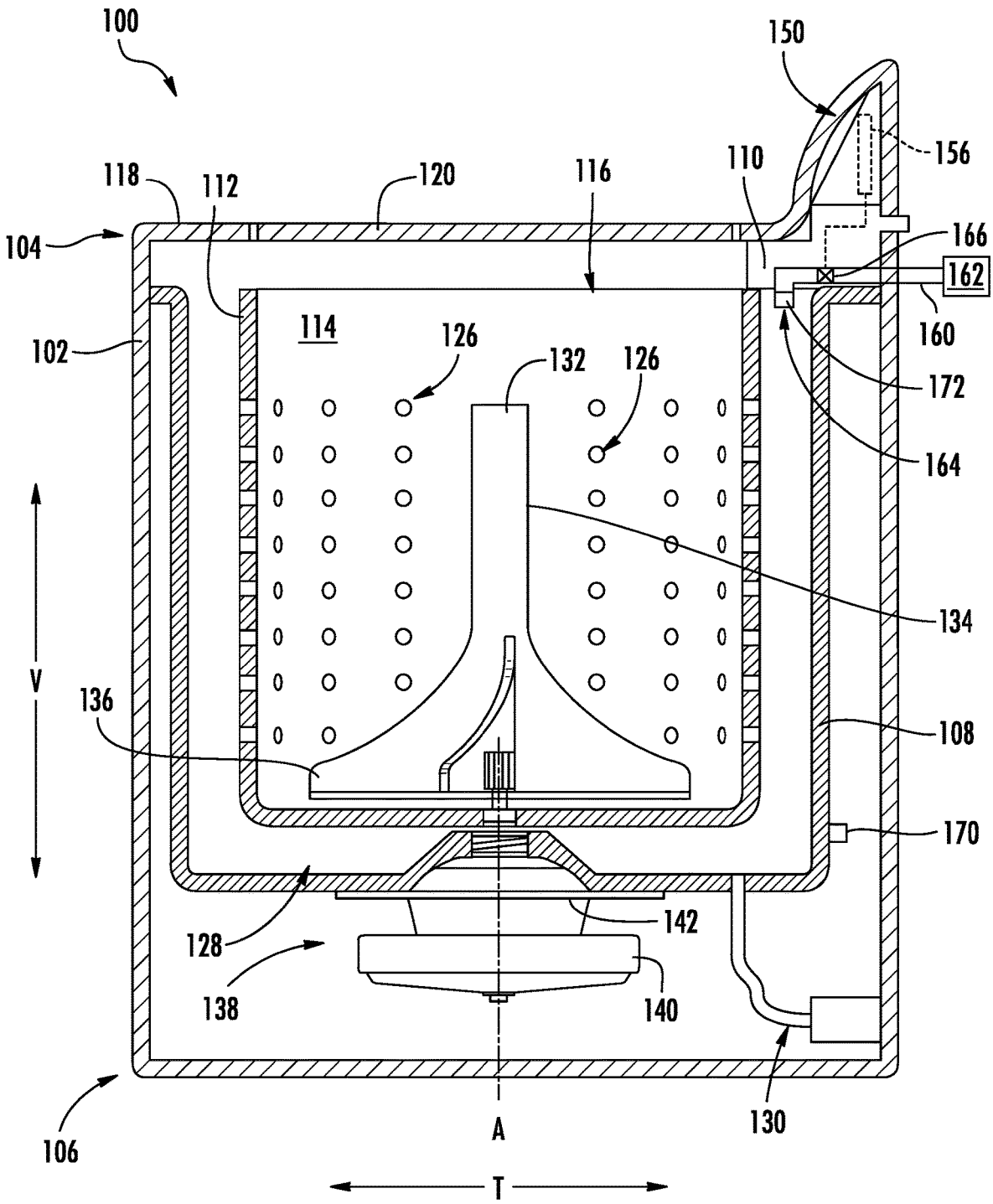
FIG. 3 provides a cut-away side view of the exemplary laundry machine appliance of FIG. 1.

FIGS. 1 through 3 illustrate an exemplary embodiment of a vertical axis laundry machine appliance or washing machine 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, laundry machine appliance 100 includes a drum or wash basket 112 that is positioned within tub 108 and generally defines a wash chamber 114 including an opening 116 for receipt of articles for washing. More specifically, wash basket 112 may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 defines an opening (FIG. 2) that coincides with opening 116 of wash basket 112 to permit a user access to wash basket 112. Laundry machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

Figure 4:
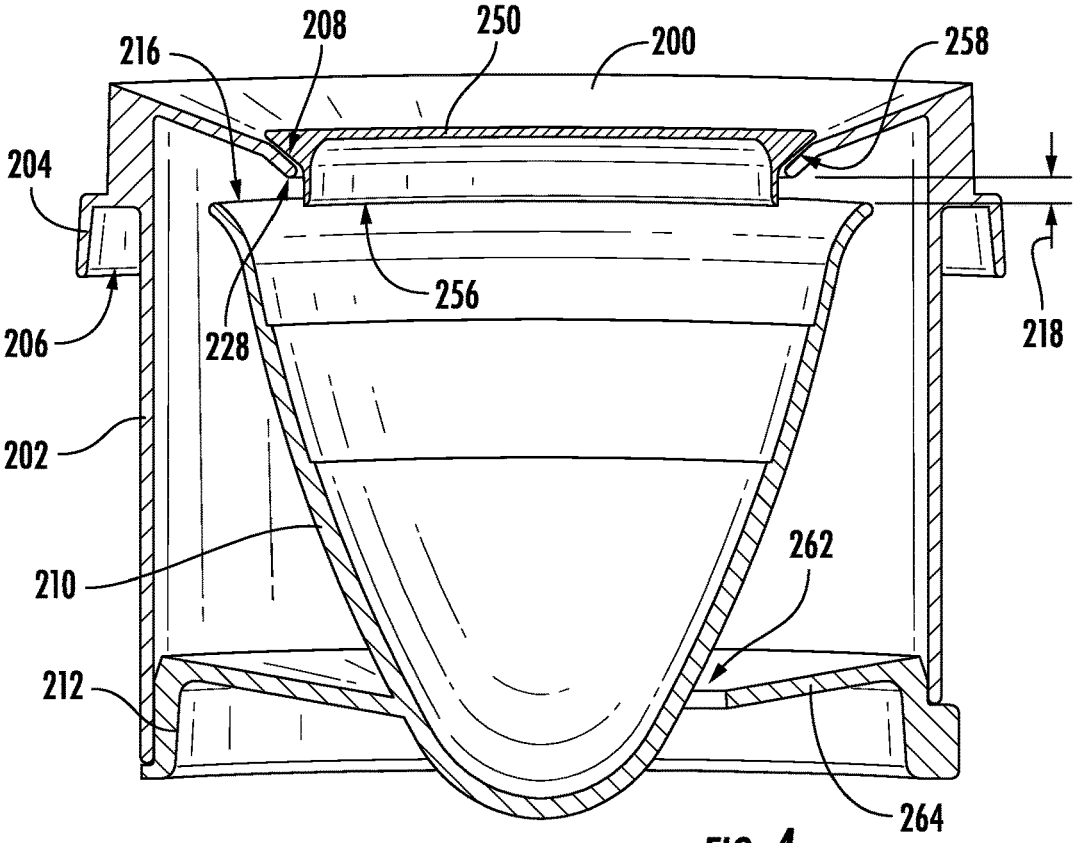
FIG. 4 provides a cut-away side view of an exemplary cup, cap, and lid for a laundry machine appliance in accordance with aspects of the present disclosure.
Figure 5:
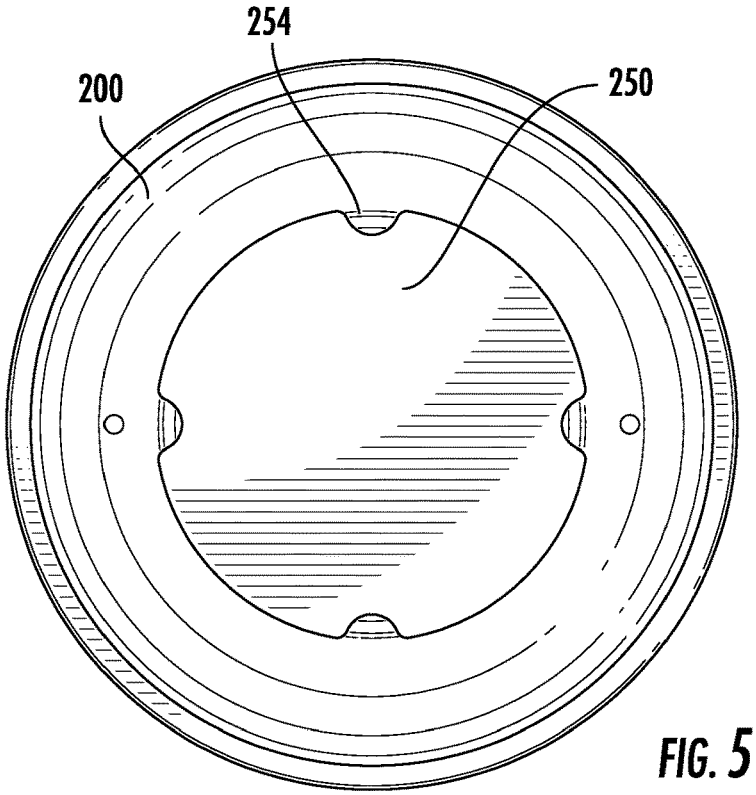
FIG. 5 provides a top-down plan view of an exemplary cap and lid of the portion of the laundry machine of FIG. 4.
Figure 6:
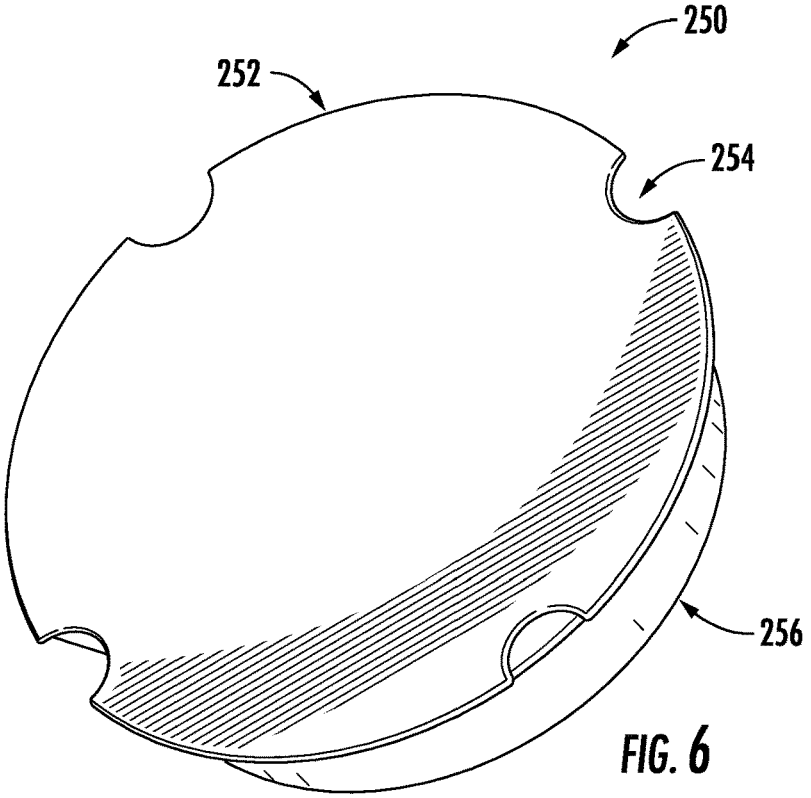
FIG. 6 provides a perspective view of an exemplary lid of the cap and lid of FIG. 5.

An impeller or agitator 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitator 132 may include a shaft 134 extending along the vertical axis V and an oscillatory member 136 extending from the shaft 134. The agitator 132 may extend into wash basket and assists agitation of articles disposed within wash basket 112 during operation of laundry machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated. In various embodiments, a fluid cup 210, a cap 200, and a lid 250, such as depicted in FIGS. 4-6 and further described herein, are positioned at a top portion of the agitator 132.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. Laundry appliance 100 may include a flow meter 172. Flow meter 172 may be connected to water supply conduit 160 to measure an amount of water added to tub 108. Flow meter 172 may send the detected water flow amount to controller 156. In addition, laundry machine appliance 100 may include one or more pressure sensors 170 for detecting the amount of water and or clothes within tub 108. For example, pressure sensor 170 may be operably coupled to a side of tub 108 for detecting the weight of tub 108. Additionally or alternatively, pressure sensor 170 may detect and/or calculate a pressure of water within tub 108.

Referring now to FIGS. 4-6, exemplary embodiments of a fluid receptacle, such as cup 210, are depicted. A base 212 is attached to the cup 210, such as to rest or affix to a vertically extending shaft 134 of the agitator 132 (FIG. 3). The cup 210 is positioned within cap 200. The cap 200 may form a substantially cylindrical wall 202 surrounding the cup 210. The cylindrical wall 202 may extend to the base 212, such as to allow the cap 200 to couple to the base 212. A bottom wall 264 may extend substantially radially from cylindrical wall 202 to the cup 210, such as to position the cup 210 within a volume in the cylindrical wall 202. The cap 200 may rest or affix upon the agitator 132 (FIG. 3), such as at the vertically extending shaft 134 of the agitator 132. For instance, in some embodiments, an outer radial wall of the cap 200 may be positioned flush with an outer wall of the shaft 134 at the agitator 132. In another instance, in some embodiments, the cap 200 may include a substantially U-shaped (or V-shaped, or other appropriate shape) catchment 204 forming a groove 206 at which the agitator 132 is receivable. In some embodiments, cup 210 and cap 200 may be assembled together from separate components and positioned into the agitator 132.

The cap 200 includes a trough wall 208 extending radially inward from the outer cylindrical wall 202 and sloped vertically downward toward the cup 210. In particular, a radially inward end 228 of the trough wall 208 is positioned above (along the vertical axis) an upper lip 216 of the cup 210. Accordingly, a clearance gap 218 is formed between the end 228 of the trough wall 208 and the upper lip 216 of the cup 210. In various embodiments, the gap 218 is greater than a height of fluid that may overflow from the cup 210 over the upper lip 216. For instance, the gap 218 may correspond to a fluid layer or surface tension of fluid that may accumulate above the upper lip 216 when overflowed from the cup 210.

Still further, in various embodiments, end 228 of the trough wall 208 extends radially inward of the upper lip 216 of the cup 210. Accordingly, fluid poured by a user through the cap 200 into the cup 210 may flow along trough wall 208 into cup 210 without spillage outside of the cup 210.

The lid 250 selectively attachable to the cap 200 at the trough wall 208. The lid 250 includes a cylindrical wall 256 extending along the vertical axis when installed onto the cap 200. The lid 250 includes a sloped wall 258 corresponding to the trough wall 208. In certain embodiments, the sloped wall 258 corresponds to the end 228 of the trough wall 208. The sloped wall 258 is configured to seal onto the trough wall 208, such as via a tight fit, press fit, or interference fit. A lower end of the cylindrical wall 256 may extend to co-planar to the upper lip 216 of the cup 210 when the lid 250 is fully seated onto the cap 200.

In various embodiments, the lid 250 includes an outer diameter 252 at which one or more grooves 254 extend radially inward from the outer diameter 252. For instance, grooves 254 may form openings allowing for a user's finger or other digit or member to extend thereinto to grab, pry, or otherwise release the lid 250 from the cap 200.

Figure 7:
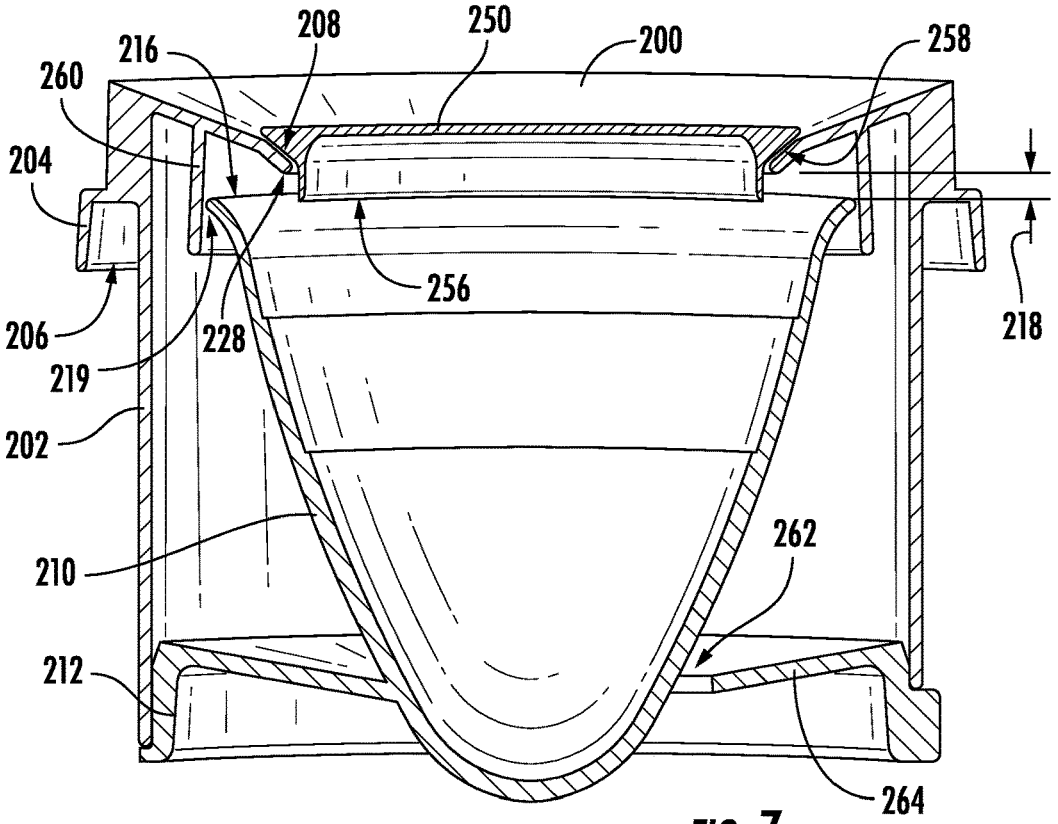
FIG. 7 provides a cut-away side view of a an exemplary cup, cap, and lid for a laundry machine appliance in accordance with aspects of the present disclosure.

Referring now to FIG. 7, an exemplary embodiment of the cap 200 and lid 250 at the cup 210 is provided. The embodiment provided in FIG. 7 is configured substantially similarly as described in regard to FIGS. 4-6. In FIG. 7, an inner cylindrical wall 260 extends vertically from the trough wall 208. The inner cylindrical wall 260 is positioned between the upper lip 216 of the cup 210 and the outer cylindrical wall 202. A radial gap 219 is formed between the inner cylindrical wall 260 and the upper lip 216 of the cup 210. The radial gap may allow for fluid in the cup 210 to move therethrough, such as at the end of a wash portion of the wash cycle (e.g., at a spin cycle). The fluid may exit through an opening 262 through the bottom wall 264 of the cup 210 and through an opening at the agitator 132, such as to distribute the fluid through the wash basket 112.

In various embodiments, the lid 250, the cap 200, or both, may include a substrate including one or more of Dioctyl dimethyl ammonium chloride, Didecyl ammonium chloride, Quaternium, n-Alkyl dimethylbenzyl ammonium chloride, or combinations thereof, to provide an antimicrobial surface to inhibit growth or propagation of bacterial growth on the lid, such as may occur when fluid (e.g., fabric softener, detergent, etc.) is poured or spilled from the cup 210.

Embodiments of the laundry machine appliance 100 provided herein including embodiments of the cap 200, the cup 210, the lid 250, or combinations thereof, may mitigate fluid leakage when a user overfills the cup 210 at the agitator 132, such as may mitigate rust, corrosion, or other deterioration of the wash basket 112. Embodiments of the laundry machine appliance 100 provided herein including embodiments of the cap 200, the cup 210, the lid 250, or combinations thereof, may provide a sufficient gap between the upper lip 216 of the cup 210 and the bottom edge of the trough wall 208 of the cap 200 such that fluid may escape when the wash basket 112 spins up (e.g., at the end of a wash portion of the wash cycle).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry machine appliance, comprising:

a tub and a wash basket rotatably provided within the tub;

an agitator disposed in the wash basket to impart an oscillatory motion in the wash basket, the agitator comprising a vertically extending shaft and an oscillatory member extending from the shaft;

a cup comprising an upper lip, wherein the cup is attached to a base positioned at the shaft of the agitator; and a cap positioned atop the shaft of the agitator, the cap comprising an outer cylindrical wall and a trough wall extending radially inward from the outer cylindrical wall and sloped vertically downward toward the cup, the trough wall comprising a radially inward end positioned vertically upward of the upper lip of the cup, wherein a clearance gap is formed between the upper lip and the inward end of the trough wall, the cap comprising an inner cylindrical wall extending vertically from the trough wall toward the cup.

2. The laundry machine appliance of claim 1, wherein the clearance gap corresponds to a fluid layer of fluid that may accumulate above the upper lip of the cup.

3. The laundry machine appliance of claim 1, comprising:

a lid selectively attachable to the cap at the trough wall, the lid comprising a cylindrical wall extending vertically when attached to the cap, the lid comprising a sloped wall corresponding to the trough wall.

4. The laundry machine appliance of claim 3, wherein the sloped wall is configured to seal onto the trough wall as an interference fit, a press fit, or a tight fit.

5. The laundry machine appliance of claim 3, wherein a lower end of the cylindrical wall extends co-planar to the upper lip of the cup when the lid is attached to the cap.

6. The laundry machine appliance of claim 3, wherein the lid comprises an outer diameter from which a groove extends radially inward, wherein the groove forms an opening allowing for release of the lid from the cap.

7. The laundry machine appliance of claim 3, wherein the lid comprises a substrate comprising one or more of Dioctyl dimethyl ammonium chloride, Didecyl ammonium chloride, Quaternium, n-Alkyl dimethylbenzyl ammonium chloride, or combinations thereof.

8. The laundry machine appliance of claim 1, wherein the inner cylindrical wall is positioned between the upper lip of the cup and the outer cylindrical wall.

9. The laundry machine appliance of claim 1, wherein a gap is formed between the inner cylindrical wall and the upper lip of the cup.

10. A top-load laundry machine appliance, comprising:

a tub and a wash basket rotatably provided within the tub;

an agitator disposed in the wash basket to impart an oscillatory motion in the wash basket, the agitator comprising a vertically extending shaft and an oscillatory member extending from the shaft;

a cup comprising an upper lip, wherein the cup is attached to a base positioned at the shaft of the agitator;

a cap positioned atop the shaft of the agitator, the cap comprising an outer cylindrical wall and a trough wall extending radially inward from the outer cylindrical wall and sloped vertically downward toward the cup, the trough wall comprising a radially inward end positioned vertically upward of the upper lip of the cup, wherein a clearance gap is formed between the upper lip and the inward end of the trough wall, the cap comprising an inner cylindrical wall extending vertically from the trough wall toward the cup; and a lid selectively attachable to the cap at the trough wall, the lid comprising a cylindrical wall extending vertically when attached to the cap, the lid comprising a sloped wall corresponding to the trough wall.

11. The top-load laundry machine appliance of claim 10, wherein the clearance gap corresponds to a fluid layer of fluid that may accumulate above the upper lip of the cup.

12. The top-load laundry machine appliance of claim 10, wherein the sloped wall is configured to seal onto the trough wall as an interference fit, a press fit, or a tight fit.

13. The top-load laundry machine appliance of claim 10, wherein a lower end of the cylindrical wall extends co-planar to the upper lip of the cup when the lid is attached to the cap.

14. The top-load laundry machine appliance of claim 10, wherein the lid comprises an outer diameter from which a groove extends radially inward, wherein the groove forms an opening allowing for release of the lid from the cap.

15. The top-load laundry machine appliance of claim 10, wherein the lid comprises a substrate comprising one or more of Dioctyl dimethyl ammonium chloride, Didecyl ammonium chloride, Quaternium, n-Alkyl dimethylbenzyl ammonium chloride, or combinations thereof.

16. The top-load laundry machine appliance of claim 10, wherein the cap comprises a substrate comprising one or more of Dioctyl dimethyl ammonium chloride, Didecyl ammonium chloride, Quaternium, n-Alkyl dimethylbenzyl ammonium chloride, or combinations thereof.

17. The top-load laundry machine appliance of claim 10, wherein the inner cylindrical wall is positioned between the upper lip of the cup and the outer cylindrical wall.

18. The top-load laundry machine appliance of claim 10, wherein a gap is formed between the inner cylindrical wall and the upper lip of the cup.

* * * * *